United States Patent [19]

Färber et al.

[11] 4,325,299

[45] Apr. 20, 1982

[54] HOUSEHOLD APPLIANCE, ESPECIALLY A GARBAGE COMPACTOR

[75] Inventors: Karl-Heinz Färber, Giengen; Alexander Rupp, Sontheim-Bergenweiler, both of Fed. Rep. of Germany

[73] Assignee: Bosch-Siemens Hausgeräte GmbH, Stuttgart, Fed. Rep. of Germany

[21] Appl. No.: 174,874

[22] Filed: Aug. 4, 1980

[30] Foreign Application Priority Data

Aug. 3, 1979 [DE] Fed. Rep. of Germany ..... 2931537

[51] Int. Cl.[3] ..... B30B 15/06

[52] U.S. Cl. ..... 100/295; 100/229 A

[58] Field of Search ..... 100/229 A, 295

[56] References Cited

U.S. PATENT DOCUMENTS

| | | | |
|---|---|---|---|
| 3,613,568 | 10/1971 | Bottas | 100/229 A |
| 3,788,212 | 1/1974 | Doepke | 100/229 A |
| 3,960,071 | 6/1976 | Mayer | 100/229 A |

FOREIGN PATENT DOCUMENTS

| | | | |
|---|---|---|---|
| 2356534 | 5/1975 | Fed. Rep. of Germany | 100/295 |

*Primary Examiner*—Billy J. Wilhite

*Attorney, Agent, or Firm*—Herbert L. Lerner; Laurence A. Greenberg

[57] ABSTRACT

Household garbage compactor, including a press or stamper for executing a piston stroke for given short periods of time in a container disposed in a frame holding garbage to be compacted, a pressure plate for compacting the garbage, and a device for easily releasably holding and re-attaching the pressure plate to the press means.

4 Claims, 2 Drawing Figures

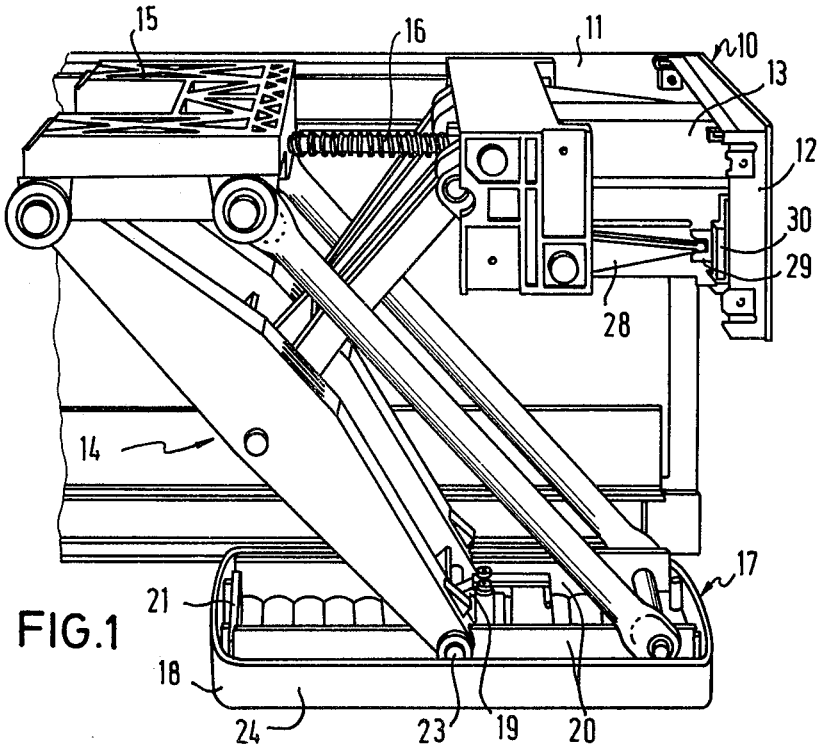
FIG.1
FIG.2
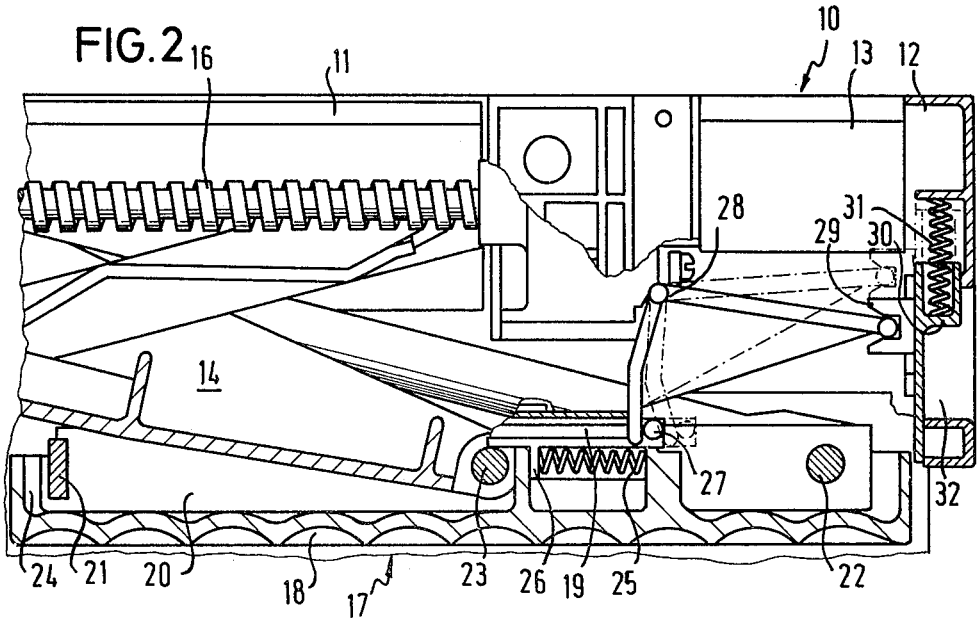

HOUSEHOLD APPLIANCE, ESPECIALLY A GARBAGE COMPACTOR

The invention relates to a household appliance, especially a garbage compactor including a container disposed in a frame for holding the garbage which is to be compacted, and also a stamper which executes a piston stroke and is in the form of a press with a pressure plate, through which the pressure plate can be moved into the container for short periods at a time.

Household appliances of this type are generally provided with a press ram or pressure piston having a pressure plate which acts on the refuse and can be removed. However, this can be done only after removing a number of removable connecting elements with the aid of special tools. The object therefore is only to be able to remove the pressure plate in case of a repair. Therefore, in many cases the removal of the pressure plate is only possible after the press mechanism has been taken out of the household garbage compactor.

It has, however, been proven to be necessary, or at least desirable with the use of such garbage compactors, to dispose the pressure plate on the press-ram in such a manner that it can be removed without great difficulty and without the use of special tools, and that it can be again attached to the appliance in an equally simple way. The reason for this is the fact that household refuse is formed to a great degree of soft and moist substances, which easily cling to the pressure stamper during compacting, get incrusted, and decay there. This can therefore cause strong offensive odors. It has also been shown that sometimes parts of the household garbage which squeeze through between the wall of the container and the rim of the pressure plate during the press-operation, collect on the upper side of the pressure plate, where they also decay, and thereby cause strong offensive odors. In the conventional garbage compactors with a fixed pressure plate, this remaining refuse collected in this manner on the upper side of the pressure plate can only be removed if the press-ram of the appliance is lowered, with the container taken out of the appliance, far enough so that its upper side is accessible from the outside. The cleaning must therefore be done in the appliance itself, and is accordingly relatively difficult and not sufficiently thorough.

Therefore, in the past, it has been proposed to place a protective cover from below over the press stamper in the form of a hat-like container, which is connected with the press stamper by means of removable fasteners. However, such a protective cover is quite costly, and difficult to attach to the press ram because of its wide rim, even if it is connected with easily removable fastening means. Furthermore, since these fasteners are themselves located in a region where they collect a lot of dirt themselves, the removal and attachment of the protective cover onto the press ram at the location of the household garbage compactor is very difficult and requires great skill. The removal and attachment of the protective cover to the press ram is also further complicated by the fact that the cover, on its outside, usually has become very dirty by the preceding use of the appliance.

It is accordingly an object of the invention to provide a household appliance, especially a garbage compactor, which overcomes the hereinafore-mentioned disadvantages of the heretofore-known devices of this general type, and to construct the press mechanism of the household appliance in such a manner that the pressure plate can be taken off without difficulty at any time, for cleaning purposes, and can equally simply be attached again on the press mechanism after cleaning.

With the foregoing and other objects in view there is provided, in accordance with the invention, a household garbage compactor, comprising a press or stamper for executing a piston stroke for given short periods of time in a container disposed in a frame holding garbage to be compacted, a pressure plate for compacting the garbage, and means for easily releasably holding and reattaching the pressure plate to the press means.

Therefore the invention achieves this objective by arranging the pressure plate at the press mechanism with easily released fastening means, in such a manner, that it can be easily taken off the press mechanism, if necessary, for example, for cleaning, and also can be easily attached again on the latter.

With the aid of a pressure plate constructed according to the invention with easily releasable holding means at the press mechanism, it is possible to considerably improve the hygienic conditions of household garbage compactors, because the pressure plate can be removed from the press ram by hand with a few simple motions at any time, and thereafter be attached to the press ram again.

In accordance with another feature of the invention, the press has an end facing toward the pressure plate, and there is provided a support frame disposed on the end of the press, and at least three support points formed on the back surface of the pressure plate bearing against the support frame.

Due to this special construction, the forces occurring in the press mechanism during the press operation are mainly absorbed by the support frame, whereby the load on the pressure plate is kept low, so that the pressure plate can be light weight and of a form that is easily handled. If based only on this fact alone, the pressure plate would be easy to manipulate and to clean.

In accordance with a further feature of the invention, there is provided a profile of positive half waves having crests extending over the area of the pressure plate, the crests forming the support points, the support frame including longitudinal members braced against the crests.

In accordance with an added feature of the invention, there are provided means disposed on the rear side of the pressure plate for guiding and laterally fixing the position of the pressure plate with respect to the support frame.

In accordance with an additional feature of the invention, the pressure plate has a surface facing the support frame, and the holding means are in the form of a spring-loaded latch disposed on the surface of the pressure plate above the center of gravity thereof, and there is provided a rod passing through the middle of the support frame and being engageable by the latch.

In accordance with a concomitant feature of the invention, the support plate is in the form of a press ram movable into an upper dead center position by the press means, and there is provided a transfer mechanism for releasing the latch, a service panel, and releasing means disposed in the service panel for activating the transfer mechanism to release the latch for removing the pressure plate in the upper dead center position.

Other features which are considered as characteristic for the invention are set forth in the appended claims.

Although the invention is illustrated and described herein as embodied in a household appliance, especially a garbage compactor, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a fragmentary diagrammatic perspective view showing the upper, forward portion of a household-garbage compactor whose sidewall is removed to show the pressing mechanism located behind it, in the form of a parallelogram linkage or drive driven by a threaded spindle, with the press-ram approximately in a half-lowered position; and FIG. 2 is a fragmentary longitudinal-sectional view, partly broken away, showing the upper, forward portion of the household-garbage compactor according to FIG. 1, with the press-ram in the upper end-position.

Referring now to FIGS. 1 and 2 of the drawing as a whole, there is seen a household-garbage compactor 10, which is shown only in partial views and is provided with a frame 11 in the conventional manner. Control and safety means for the operation of the press mechanism 14 are located at the upper front side of the compactor 10, behind a service panel 12 disposed in a protective housing 13. In the illustrated embodiment, the press-mechanism 14 is constructed as a parallelogram linkage which can be activated by a carriage 15 that is horizontally movable in the upper region of a frame 11, through a threaded spindle 16, and an electric motor drive which is not shown in the drawing. The horizontal displacement of the carriage 15 is changed to a vertical motion or stroke with the aid of guiding means through the parallelogram linkage of the press-mechanism 14, whereby a press-ram 17 which is connected to the parallelogram linkage, enters into a non-illustrated container for the garbage that is to be compacted. The press-ram 17 is provided with a pressure plate 18 which is disposed in the press mechanism 14 with easily disconnectable holding means in the form of a spring-loaded latch. The plate 18 is connected in such a manner that it can be easily removed from the press mechanism, if necessary for cleaning purposes, for example, and can just as easily be re-attached again.

For this purpose the press mechanism 14 is provided with a supportframe at the side facing the press-ram 17. The frame includes two longitudinal members 20 standing upright on their edges. These members are connected with each other by a rectangular frame leg 21 and a cross bar 22. The levers of the parallelogram linkage which serve as the press mechanism 14, articulate with the longitudinal members 20 of the support frame, at the ends thereof which are furthest away from the carriage 15, and the support frame is provided with corresponding bearing pins for this purpose. In this way the bearing pins of one of the lever-pairs of the parallelogram linkage are formed by the outward ends of the bar 22 extending beyond the frame, while the other lever-pair is supported on a rod 23, which is disposed in the frame approximately in the middle of the longitudinal members 20.

The pressure plate 18 is provided, on its upper side toward the support frame, with a rim 24 which runs around its circumference, and banks against the frame with several support points which are disposed on its rear side. These support points are formed by the crests of a wave-profile including positive half-waves which extend over the area of the pressure plate 18, so that a uniform contact of the pressure plate 18 on the longitudinal members 20 of the frame is assured. Furthermore, the pressure plate 18 is provided on its rear side with non-illustrated means for centering it with respect to the frame. These centering means which, for example, may be formed as wedge surfaces, have the purpose of facilitating the reattachment of the pressure plate 18 which had been removed from the frame.

As already mentioned, a spring loaded latch 19 is disposed on the rear side of the pressure plate 18 which is disposed above the center of gravity of the pressure plate 18, and engages with its tongue over the rod 23 that extends through the middle of the support frame. The tongue is shown partly extended over the rod 23 in FIG. 2.

The latch 19, as especially shown in FIG. 2, is acted upon by a pressure spring 25, which is disposed in a spring housing below the latch, and which is braced with one of its ends against a plate 26 that extends below the latch. The latch 19 is provided at the end thereof opposite its tongue, with a pin 27, which projects sideward from its guide. The pin is acted upon by the end of one arm of a two-armed lever 28. This lever 28 is supported on a crossbar which is disposed in the frame 11 in such manner that its other arm is directed toward the rear side of the service panel 12. It is guided there in a fork 29 which is located at the rear side of a slider or releasing means 30. The spring loaded slider 30 can be moved or slid against the force of a pressure spring 31, and is supported at the rear side of the service panel 12 through a window 32 that is accessible from the front-side. As indicated by dotted lines in FIG. 2, the lever 28 can be swung or moved with the aid of the slider 30 and the fork 29 on the rear side thereof. The lever 28 moves by setting the slider 30 upward against the force of the pressure spring 31 which is located behind the service panel 12. If the press-ram 17 is in its upper, dead center position, according to FIG. 2, the latch 19 is moved to the right by the downward extending arm of the double-armed lever 28. This is effected by the sideward extending pin 27 by which the latch 19 is moved against the force of the spring 25 far enough, so that the rod 23 is released and the pressure plate 18 is unlocked; this is also indicated by dotted lines in FIG. 2.

With the hereinafore-described and illustrated transfer mechanism which includes the slider 30 and the lever 28, the pressure plate 18 can, in an easy manner, be separated or removed only by operating the slider 30 in the service panel 12 of the household garbage compactor 10, under the condition that the press-ram 17 is in the upper dead center position. Therefore the pressure plate 18 can be received or caught by the hand of the operator which, for example, is protected by a cleaning rag or the like, and be removed from the garbage compactor 10, and thereafter be cleaned. This cleaning can thus also be done in a dishwasher.

For the re-attachment of the cleaned pressure plate 18 it is only necessary to place the latter against the frame of the press mechanism 17 and press it lightly upward. The plate is automatically brought into its proper position with respect to the frame by the centering means on the rear side of the pressure plate 18. A wedge-shaped surface on the upper side of the tongue of latch 19 has the effect of ensuring that the latch 19 is automatically displaced to the right against the action of the pressure spring 25 by contacting the rod 23 when the pressure plate 18 is placed against the frame, and thereafter the latch snaps-in above the rod 23. Now the cleaned pressure plate 18 again seats securely on the press-ram 17.

There are claimed:

1. Household garbage compactor, comprising press means for executing a piston stroke for given periods of time in a container holding garbage to be compacted, a pressure plate for compacting the garbage, means for easily releasably holding and re-attaching said pressure plate to said press means, said holding means being continuously accessible and manually actuatable from without the compactor when the compactor is in a closed and operational condition, said press means having an end facing toward said pressure plate, a support frame disposed on said end of said press means, said pressure plate having a surface facing said support frame, said holding means being in the form of a spring-loaded latch disposed on said surface of said pressure plate above the center of gravity thereof, a rod passing through the middle of said support frame and being engageable by said latch, said pressure plate being in the form of a press ram movable into an upper dead center position by said press means, a transfer mechanism for releasing said latch, a service panel having an opening to the outside of the compactor formed therein, and releasing means disposed in said service panel for manually activating said transfer mechanism from without the compactor through said opening to release said latch for removing said pressure plate in said upper dead center position.

2. Household garbage compactor according to claim 1, including at least three support points formed on said pressure plate bearing against said support frame.

3. Household garbage compactor according to claim 2, including a profile of positive half waves having crests formed on said pressure plate, said crests forming said support points, said support frame including longitudinal members braced against said crests.

4. Household garbage compactor according to claim 2 or 3, including means disposed on said pressure plate for guiding and laterally fixing the position of said pressure plate with respect to said support frame.

* * * * *